US009204717B2

(12) United States Patent
Moita Gorgulho Soares Branco

(10) Patent No.: US 9,204,717 B2
(45) Date of Patent: Dec. 8, 2015

(54) WORK SURFACE WITH INTERACTIVE AREA FOR CONTROLLED LABORATORY ENVIRONMENT

(71) Applicant: José Carlos Moita Gorgulho Soares Branco, Maia (PT)

(72) Inventor: José Carlos Moita Gorgulho Soares Branco, Maia (PT)

(73) Assignee: LABORIAL, SOLUCOES PARA LABORATORIO, S.A., Maia (PT)

( * ) Notice: Subject to any disclaimer, the term of this patent is extended or adjusted under 35 U.S.C. 154(b) by 0 days.

(21) Appl. No.: 14/357,501

(22) PCT Filed: Oct. 22, 2012

(86) PCT No.: PCT/IB2012/053122

§ 371 (c)(1),
(2) Date: May 9, 2014

(87) PCT Pub. No.: WO2013/068858

PCT Pub. Date: May 16, 2013

(65) Prior Publication Data

US 2014/0299025 A1 Oct. 9, 2014

(30) Foreign Application Priority Data

Nov. 11, 2011 (PT) ..... 105999

(51) Int. Cl.
*A47B 37/00* (2006.01)
*A47B 21/007* (2006.01)
(Continued)

(52) U.S. Cl.
CPC ..... *A47B 21/007* (2013.01); *A47B 13/00* (2013.01); *A47B 13/12* (2013.01); *A47B 37/00* (2013.01); *A47B 2037/005* (2013.01)

(58) Field of Classification Search
CPC ... A47B 37/00; A47B 2037/005; A47B 31/02
USPC ..... 108/50.13, 50.01, 161, 90, 23
See application file for complete search history.

(56) References Cited

U.S. PATENT DOCUMENTS 3,204,545 A * 9/1965 Benson ..... 108/50.13
3,442,230 A * 5/1969 Polen ..... 108/50.13
(Continued)

FOREIGN PATENT DOCUMENTS

DE 20 2007 002 561 U1 5/2007

OTHER PUBLICATIONS

International Search Report, mailed Oct. 12, 2012 in connection with PCT International Application No. PCT/IB2012/053122, filed Oct. 22, 2012.

(Continued)

*Primary Examiner* — Jose V Chen
(74) *Attorney, Agent, or Firm* — John P. White; Cooper & Dunham LLP

(57) ABSTRACT

Work surface with interactive area for access to a computerized device, with application in laboratories, clean rooms, environments where there is a risk of explosion and health spaces, including controlled environment concerning aseptic conditions, chemical, thermal and/or mechanical resistance. It comprises a work surface with top plate (1) and a supplementary plate (3), with normal use in a laboratory; touch detection system (2, 6), incorporated inside of a suitable enclosure (5); a screen (7) and other components inside the enclosure (5) under the work surface; supporting components (4, 8). Use on countertops, fume hoods, laboratory furniture, vertical panel, with use of aseptic materials or easy to decontaminate, or in environments with fewer restrictions, or in hospital areas, in situations where the users have to work wearing gloves and simultaneously make registers, in areas of high chemical and/or thermal loads.

20 Claims, 9 Drawing Sheets

(51) Int. Cl.
*A47B 13/00* (2006.01)
*A47B 13/12* (2006.01)

(56) References Cited

U.S. PATENT DOCUMENTS

| | | | | |
|---|---|---|---|---|
| 4,932,332 | A * | 6/1990 | Noda | 108/50.02 |
| 5,065,832 | A * | 11/1991 | Mark | 108/50.13 |
| 2008/0115698 | A1* | 5/2008 | Beam | 108/50.02 |
| 2008/0127864 | A1* | 6/2008 | Garcia | 108/50.01 |
| 2009/0165680 | A1* | 7/2009 | Bakker et al. | 108/50.02 |
| 2009/0260547 | A1* | 10/2009 | Epstein et al. | 108/50.02 |
| 2010/0116175 | A1* | 5/2010 | Pellegrini | 108/50.02 |
| 2011/0051348 | A1 | 3/2011 | Song | |
| 2012/0186499 | A1* | 7/2012 | Chen | 108/50.13 |
| 2013/0186306 | A1* | 7/2013 | Thornley | 108/24 |
| 2014/0299025 | A1* | 10/2014 | Moita Gorgulho Soares Branco | 108/50.02 |

OTHER PUBLICATIONS

Written Opinion of the International Searching Authority, mailed Oct. 12, 2012 in connection with PCT International Application No. PCT/IB2012/053122, filed Oct. 22, 2012.

* cited by examiner

WORK SURFACE WITH INTERACTIVE AREA FOR CONTROLLED LABORATORY ENVIRONMENT

CROSS-REFERENCE TO RELATED APPLICATIONS

This application is a §371 national stage of PCT International Application No. PCT/IB2012/053122, filed Oct. 22, 2012, claiming priority of Portuguese Patent Application No. 105999, filed Nov. 11, 2011, the contents of each of which are hereby incorporated by reference in their entirety.

TECHNICAL FIELD OF THE INVENTION

The present invention relates to a work surface with interactive area for access to a computerised device, with application in laboratories and health spaces, clean rooms, and/or environments where there is a risk of explosion. It uses construction technologies and materials adapted to the reality of laboratories, including controlled environment concerning aseptic conditions, chemical, thermal and/or mechanical resistance.

SUMMARY OF THE INVENTION

This invention comprises a work surface with interactive area for access to a computerised device, with application in laboratories, on table, countertop or vertical panel, and health spaces, clean rooms, environments where there is a risk of explosion. It uses construction technologies and materials adapted to the reality of laboratories, including those concerning aseptic conditions, chemical, thermal and/or mechanical resistance.

Normally in these spaces, and due to lack of credible solutions, people choose to have an extra room for use of computer systems, making the whole collection of data and notes on sheets of paper and later making data entry on a computer for digital data processing.

There are even situations where users choose to have computes, keyboards and mouses in these spaces, disregarding safety and procedure rules, which may jeopardize their own health and the health of other users of the laboratory, as well as the contamination, of the work in progress.

This invention comprises a work surface composed of glass (1) and a plate of phenolic resins (3) with aseptic capabilities and easy decontamination. This work surface has as its main function normal use in a laboratory, providing the possibility of access to a computer system. Access to the computer system allows the interaction with multimedia content via detection system by touch (2) and (6), preferably capacitive. This equipment, is characterised by the interaction of a system controlled by a touchscreen interlace incorporated in the interior of an airtight enclosure (5) suitable to clean environments or easy decontamination. This equipment consists in placing a screen (7) and other components inside an airtight enclosure (5) fixed under the surface.

The enclosure (5) can have an active dissipation, this can be implemented using filters to avoid contamination of the surrounding air and a fan to provided proper cooling.

Thus, the invention allows the use of a computer system in environments where the characteristics of the equipment require a high biological and chemical resistance and perfectly adapted to strict standards of hygiene and safety.

BACKGROUND OF THE INVENTION

Document CN2117645 discloses a common work surface with luminaires intended for advertising, while the present invention presents a work surface with access to a computerised device, intended for laboratory and hospital environments, especially aseptic environments such as clean rooms.

Document CN2638980 discloses a plate of composite resins for use in laboratory and special laboratory environments, while the present invention presents an interactive work surface composed by the combination of two materials (particularly glass and plate of phenolic resins).

Document TW200911335 discloses an Intelligent interactive game, a table top for interactive games, while the present invention presents an interactive work surface for access to a common operating system, with laboratory and hospital applications.

Document US2010307382 discloses a computerised bench for use in schools, while the present invention consists only of a work surface with application in critical areas at the level of asepsis (laboratories and hospitals), easy to clean and disinfect.

Document GB2449524 discloses a work surface developed for use in design and/or advertising, being built on an electroluminescent table, while the present invention presents an in work surface with application in critical areas at the level of asepsis (laboratories and hospitals).

GENERAL DESCRIPTION OF THE INVENTION

This work surface is intended to be used in laboratory environments and special health environments, enabling access to a computerised device in areas of manipulation of chemical substances, such as reagents, cytotoxic substances, or even radioisotopes or biologic substances, such as microorganisms, without causing a potential focus of contamination, such as the use of conventional mouses and keyboards. This surface is also applicable in confined laboratory areas, such as clean rooms, due no its aseptic characteristics.

This surface does not have any protrusions to accumulate dust, dirt and other focus of contamination, consisting of non-porous materials and with high ease of decontamination.

The work surface is a combination of glass (1) and a plate of phenolic resins or other material such as glass (3) that ensure the conservation of asepsis in the use of the equipment:

Glass, in particular laminated glass (1) is smooth, easy to clean and disinfect, without roughness in the area of the frame of the screen allowing for the full and free use of the surface.

The complement of the surface consisting of a plate of phenolic resins or glass (3) which has as advantages resistance to scratches, wear, impact and humidity, presents a fungicide behaviour, it does not rot, it is easy to clean and disinfect, it is resistant to chemical substances and to fire, does not, melt, does not run or burst, keeping its stability over a long period of time.

The touch technology for interaction with computer programs, uses a touch detection system (2) and (6) with the following characteristics: the touch is generated from a minimum pressure, or even with physical contact, generating an easy interaction; the touch will be activated with the naked finger, using gloves or through a pen, preferably capacitive.

The enclosure (5) containing the screen (7) is supported, in particular, by connecting bars (4) and confines the area of potential contamination of the electronic devices.

The work surface is comprised of a glass and a plate of phenolic resins (3) and has a central zone interactive by touch or multi-touch for access to a computerised device. It is characterised by the absence of roughness, cracks or other irregularities that might constitute a focus of contamination.

At the base of the surface an enclosure is available, in particular metallic, in order to confine the electronic devices, contributing to the asepsis of the set. For a simple multi-touch screen, an area of use is added for the entire work surface, without any need of frame or other type of protrusion.

Preferably, the glass has a total maximum thickness of 12 mm, in particular a total maximum thickness of 8 mm. The plate of phenolic resins (3) serves as a support for the glass (1) in relation to the metal surfaces (4) and (5), thus keeping a distance preferably greater than 10 mm between the film (2) and the metallic surfaces, connecting bars (4) and the enclosure (5).

Both the glass (1) and the plate of phenolic resins (3) have a great self disinfectant and decontaminating capacity for use in aseptic environments.

The work area is for a normal usage of the laboratory with the possibility of access to a computerised device through the glass (1) by means of a touch or multi-touch system. This touch or multi-touch system consists of a detection system (2) and (6) and a screen (7).

The enclosure (5) makes the insulation of the touch detection system (2) and (6) and screen (7). The enclosure (5) is preferably a modelling without sharp edges, smooth material suitable for use in clean rooms and other types of laboratory.

The enclosure (5), the plate of phenolic resins or glass (3) and the screen (7) suspension (8) are fixed to the connecting bars (4).

The enclosure (5) may have perforations, fan and filters for interior air renewal providing active cooling. Air filtration at entrance/exit.

This equipment is design for use in clean rooms, i.e., rooms constructed to ensure the containment of the spaces and aseptic conditions required. This equipment will be used as a work area with the possibility of access to a computer system, even with the use of gloves, ensuring total asepsis and easy cleaning of the system. With the characteristics of the material used, objects at high temperatures and highly aggressive chemical substances can be used without deterioration.

This equipment can be used in countertops, fume hoods, laboratory furniture. It can be inserted in equipment intended for sites that require access to a computer system that have as main feature the use of aseptic materials or with ease of decontamination.

Being suitable for clean rooms (case with greater number of restrictions) this equipment is also adapted to be used in other types of laboratories with fewer restrictions, or even in hospital areas. In situation where users need to work wearing gloves and simultaneously make registers, this equipment becomes an asset.

In areas of high chemical and/or thermal loads, this device is also advantageous in relation to other computational devices.

The top plate (1) made of glass may be of other materials similar to glass, hard material that is transparent, non-porous, chemically resistant, in particular polycarbonate, laminated glass, chemically enriched glass for increased resistance, or tempered glass.

The supplementary plate (3) made of grass or resin can be made in other materials such as glass or resins, that is, a hard material, non-porous, chemically resistant in particular phenolic resin, medium density wood fibre board (MDF), high density wood fibre board madeira (HDF), polycarbonate, polyester or acrylic, or derivatives thereof, in particular clusters de polyester or acrylic with inert particles.

Embodiments of the invention include a supplementary plate (3) under the top plate (1) that increases the toughness of the surface without affecting the detection capacity in the area of the touch detection plate (2) and also allows, but does not oblige, the fixation of the enclosure (5) that contains the devices directly or through connecting bars (4).

Embodiments of the invention include sealing mechanisms, and optionally ventilation mechanisms, in particular with air filtering, allowing the operation in controlled environments and that also improve heat dissipation of the device.

DESCRIPTION OF FIGURES

For an easier understanding of the invention, attached are figures, which represent preferred embodiments of the invention, which, however, are not intended to limit the scope of the present invention.

Figure 1:
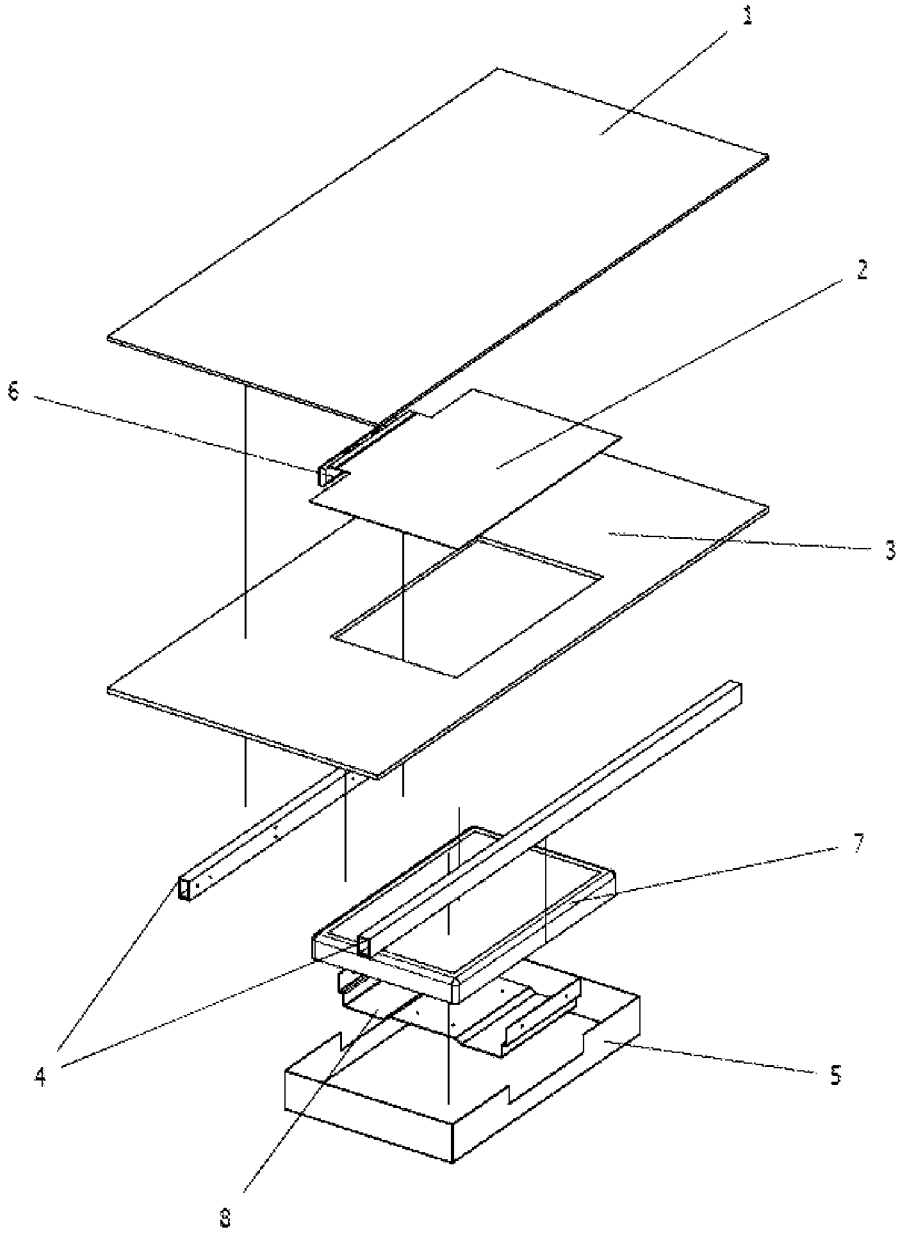
FIG. 1: Schematic representation of section of assembled equipment were (1) represents a glass top plate,
(2) represents a plate for touch detection,
(3) represents a supplementary glass or resin plate, and
(4) represents connecting bars able to support the equipment,
(5) represents an enclosure suitable for clean environments,
(6) represents supplementary elements of the touch detection system,
(7) represents a screen, and
(8) represents a suspension device able to support the screen and touch detection system on the connecting bars.
Figure 2:
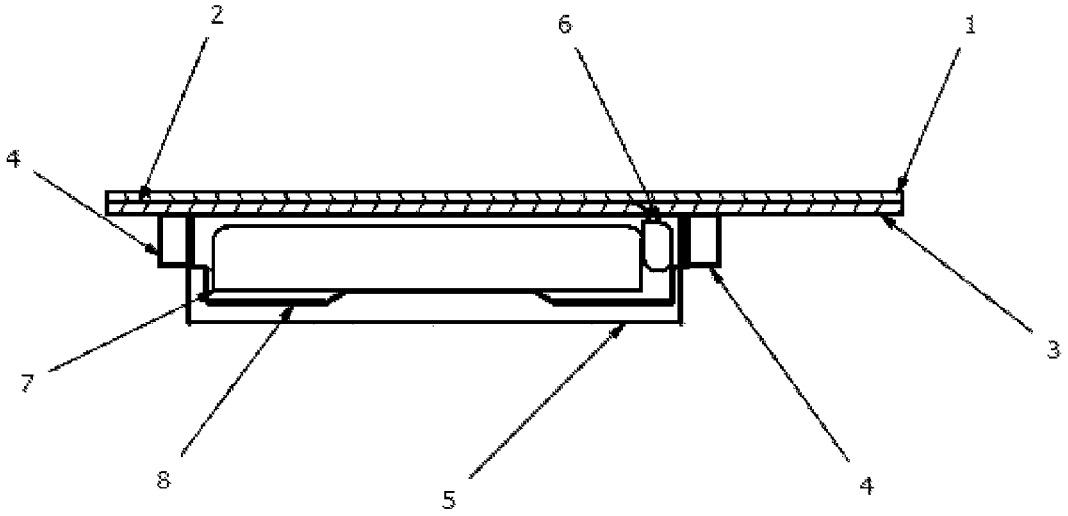
FIG. 2: Schematic representation of section of assembled equipment where (1) represents a glass top plate,
(2) represents a plate for touch detection,
(3) represents a supplementary glass or resin plate, and
(4) represents connecting bars able to support the equipment,
(5) represents an enclosure suitable for clean environments,
(6) represents supplementary elements of the touch detection system,
(7) represents a screen, and
(8) represents a suspension device able to support the screen and touch detection system on the connecting bars.
Figure 3:
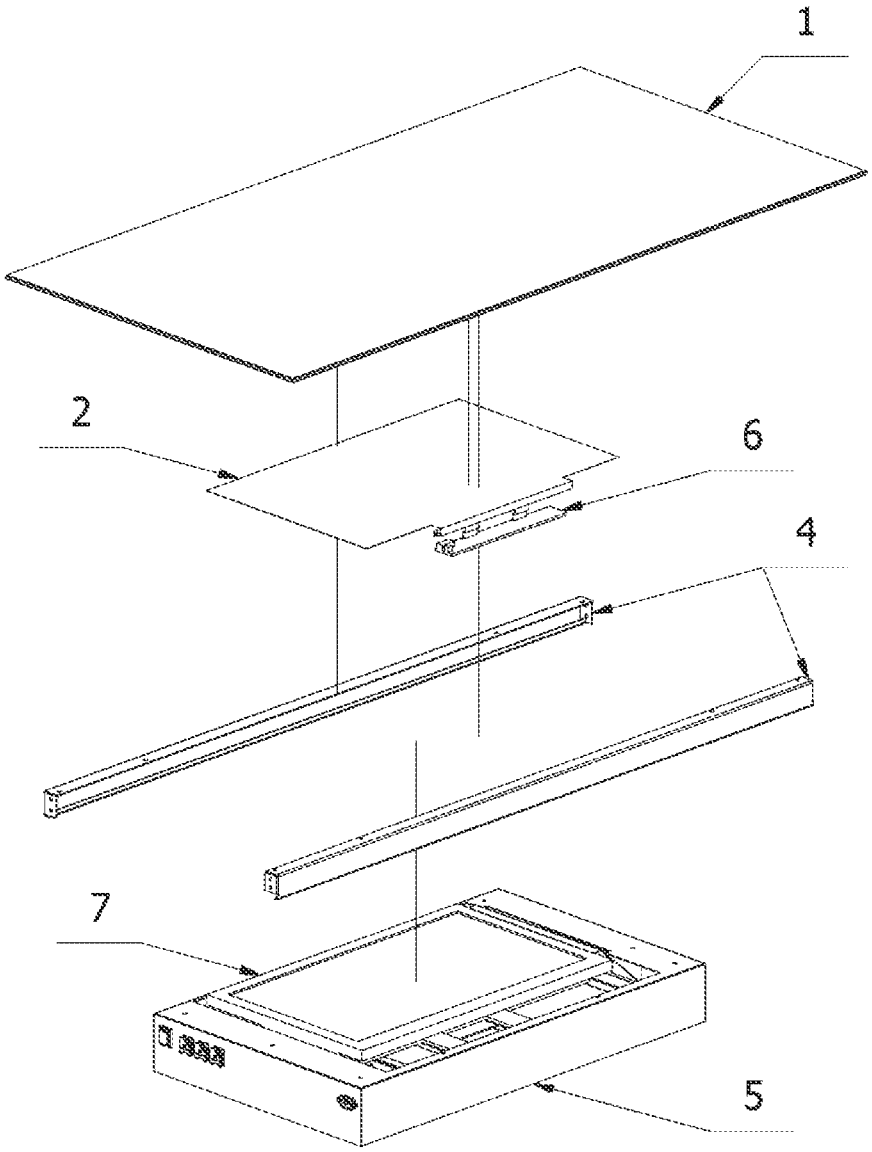
FIG. 3: Schematic representation of a drawing of assembly of the equipment of an embodiment without supplementary plate, where the enclosure (5) is coupled to the connection bars (4) able to support the equipment, which in turn are coupled to the top plate (1).
Figure 4:
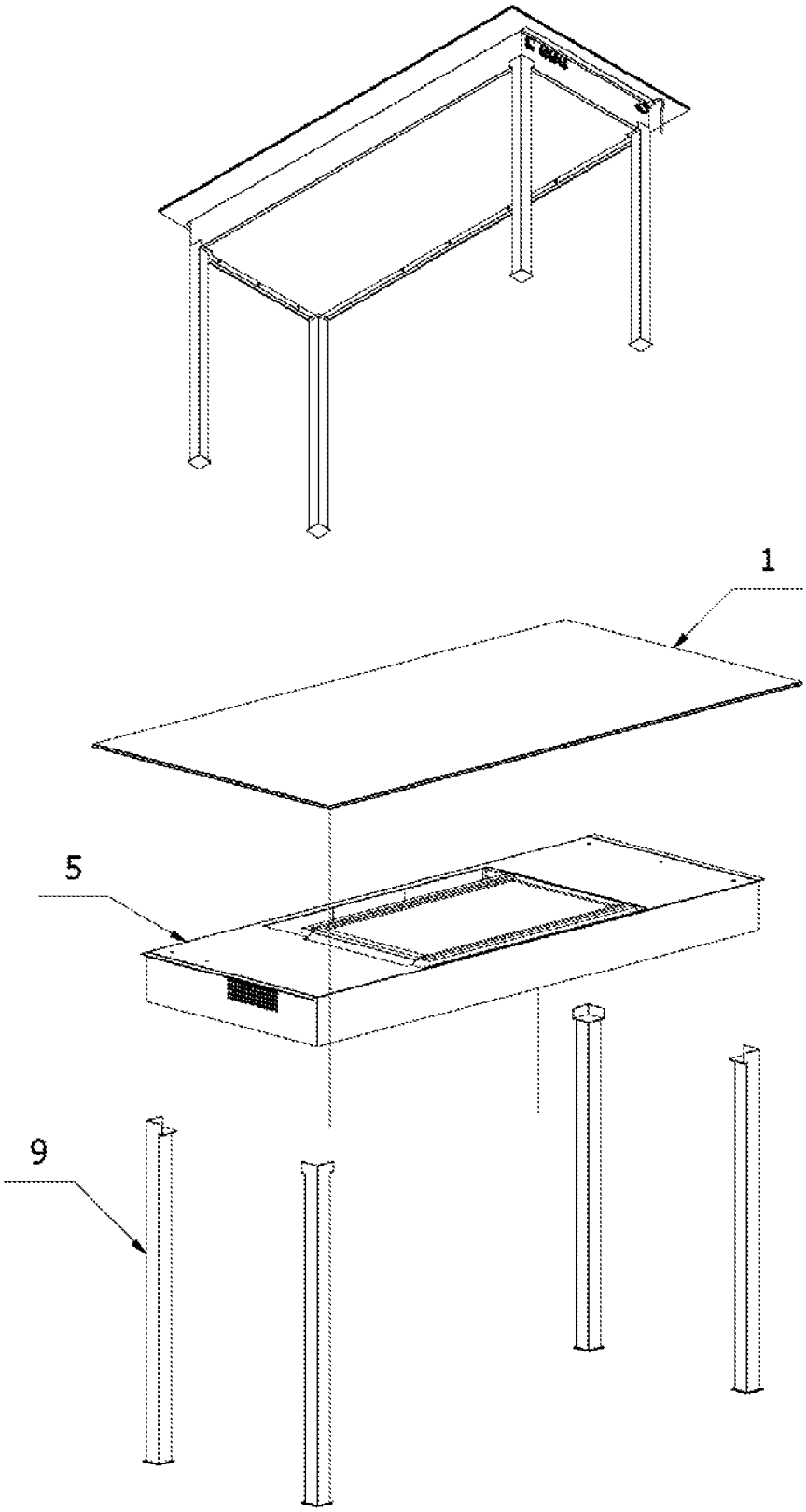
FIG. 4: Schematic representation of a drawing of assembly of the equipment of an embodiment without supplementary plate, where the enclosure (5) is coupled to the structure able to support the equipment, and the screen (7) is supported in the enclosure itself (5), in this case in particular by means of support and fixation (8), being the structure of the equipment (9), for example, legs, frames, support frames.
Figure 5:
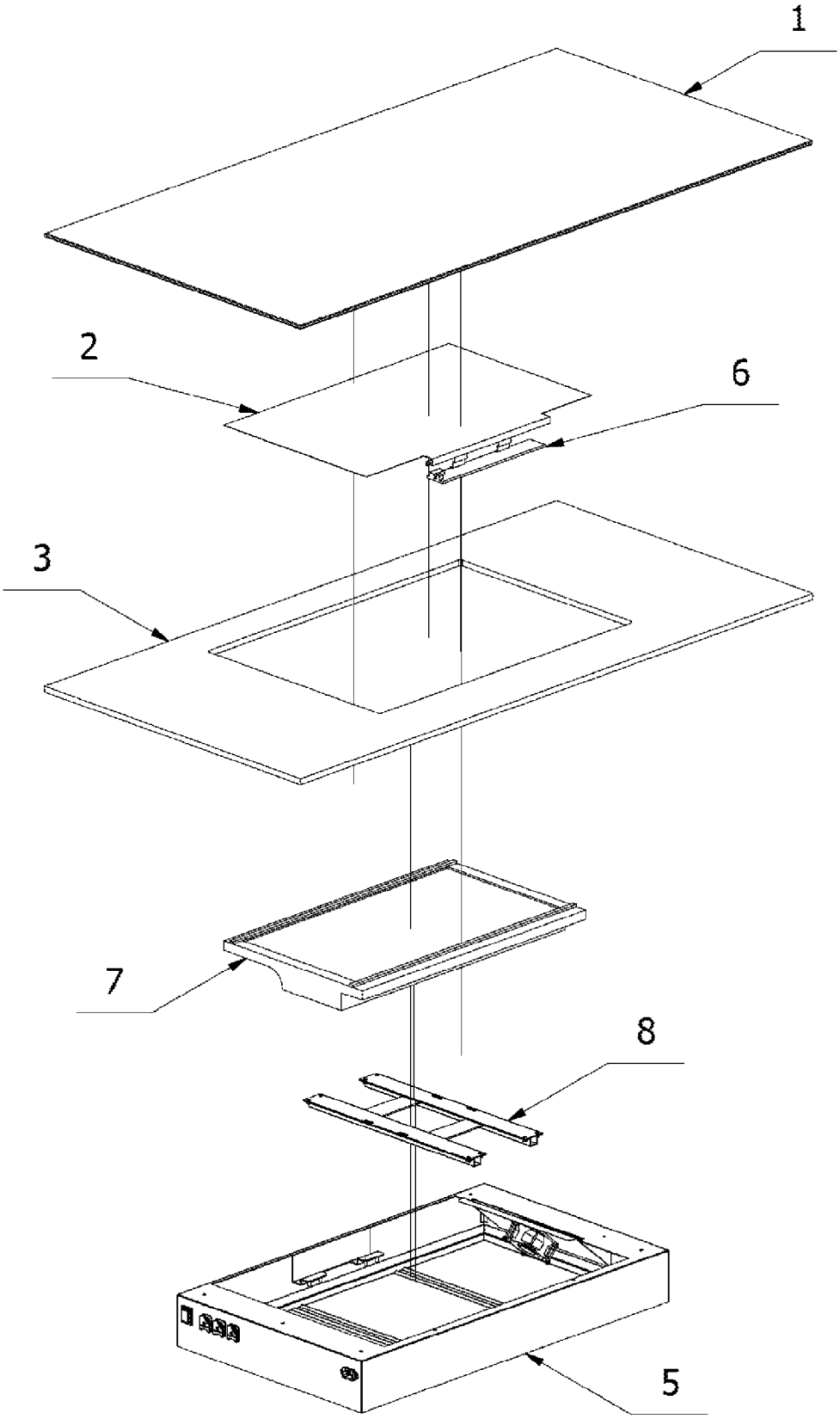
FIG. 5: Schematic representation of a drawing of assembly of the equipment of an embodiment without supplementary plate, where the enclosure (5) is coupled directly to the supplementary plate (3), being the screen (7) supported in the enclosure itself (5), in this case in particular by support and fixation means (8).
Figure 6:
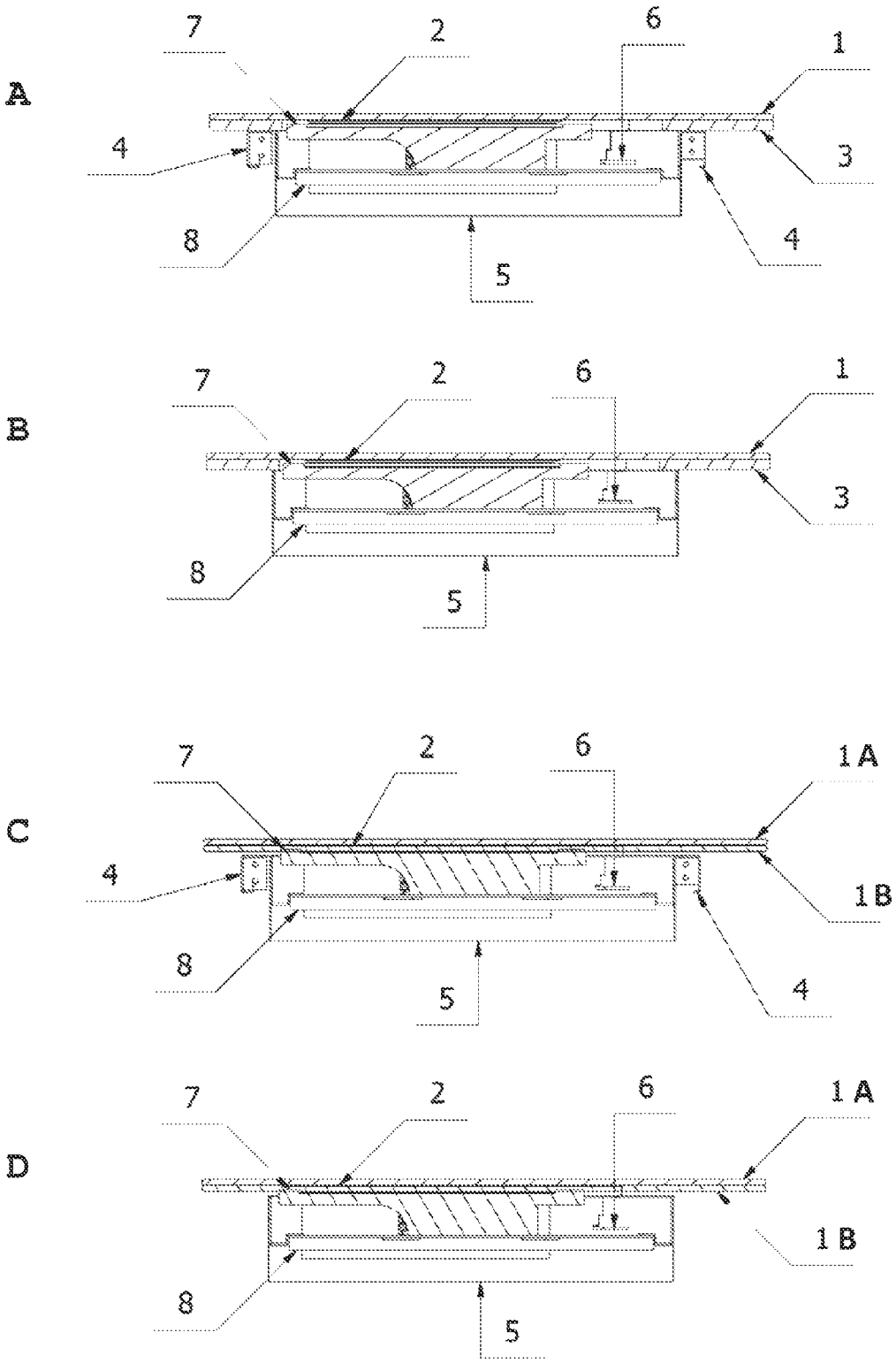
FIG. 6: Schematic representation of section of assembled equipment of various embodiments.

A—embodiment with supplementary plate (3) and connection bars (4) where the enclosure (5) is coupled to the connection bars (4) able to support the equipment, which in turn are coupled to the supplementary plate (3) or, alternatively, are coupled to the structure of the equipment (for example, legs, frames, support frames);

B—embodiment with supplementary plate (3) and without connection bars where the enclosure (5) is coupled to the supplementary plate (3) and the screen (7) is supported in the enclosure itself (5), in this case in particular by support and fixation means (8);

C—embodiment with supplementary plate (3), with a first and second top plate (1A, 1B) and connection bars (4) where the enclosure (5) is coupled to the connection bars (4) able to support the equipment, which in turn are coupled to the second top plate (1B) or are coupled to the structure of the equipment (for example, legs, frames, support frames), being the touch detection plate (2) placed between the two top plates (1).

D—embodiment without supplementary plate (3), with a first and second top plate (1A, 1B) and without connection bars where the enclosure (5) is coupled to the second top plate (1B), being the touch detection plate (2) placed between the two top plates (1).

Figure 7:
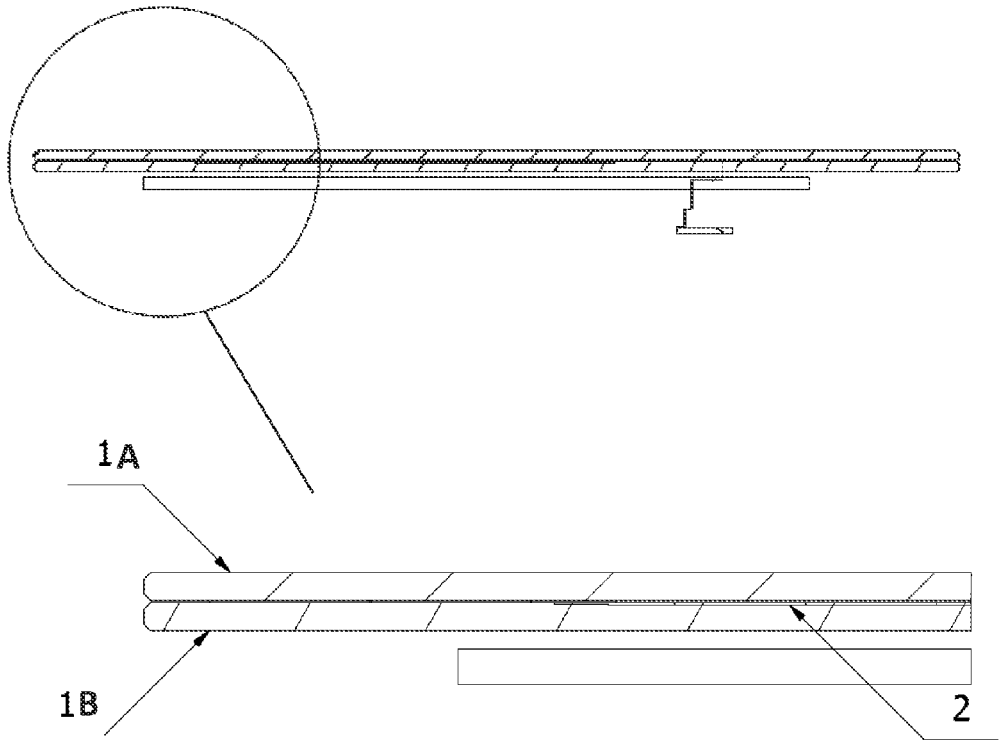

FIG. 7: Schematic representation of section of embodiment with a second top plate (1A) where the touch detection plate (2) is placed between two top plates (1B).

Figure 8:
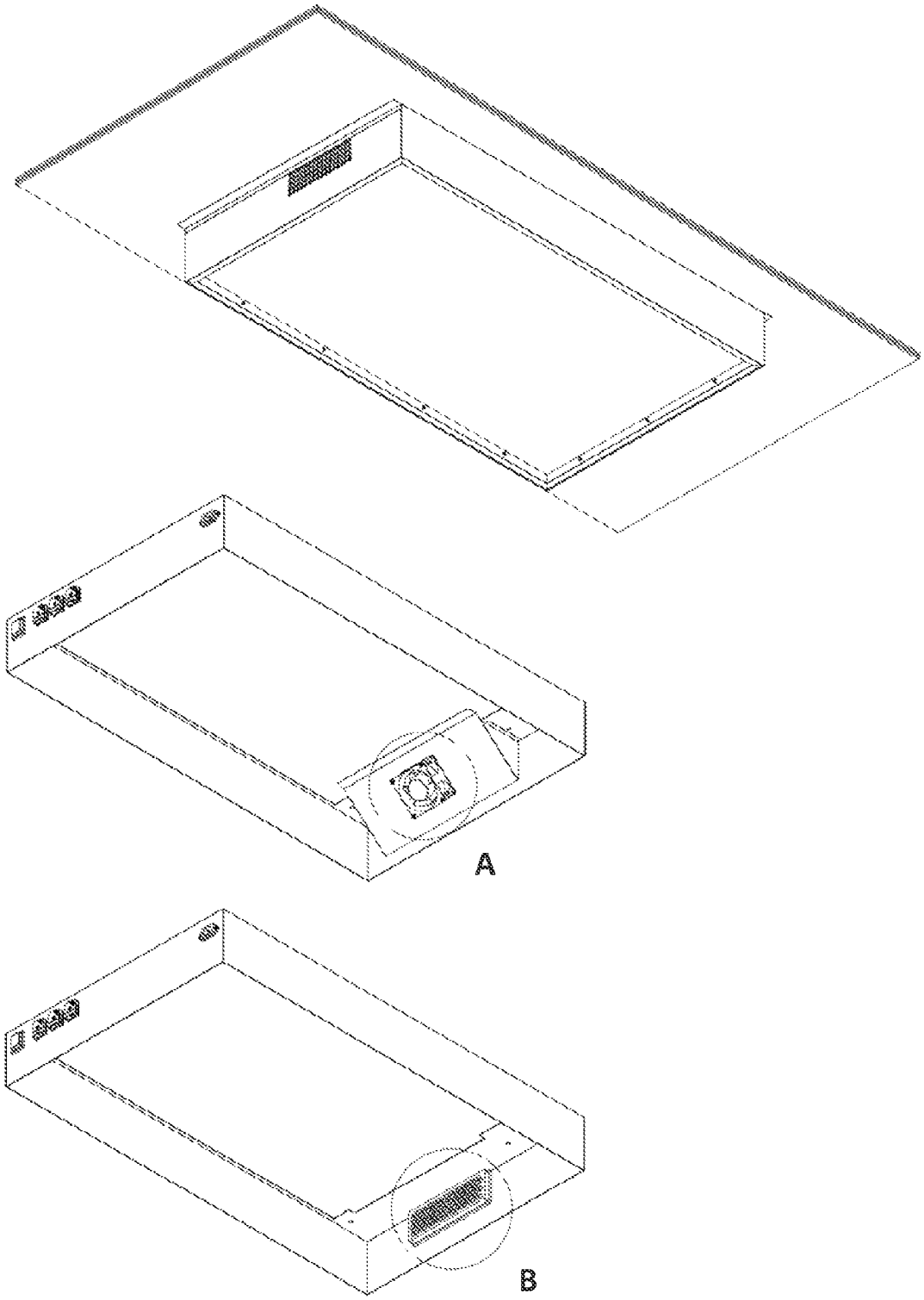

FIG. 8: Schematic representation of embodiments with fan and air filter (B) placed in the enclosure.

Figure 8A:
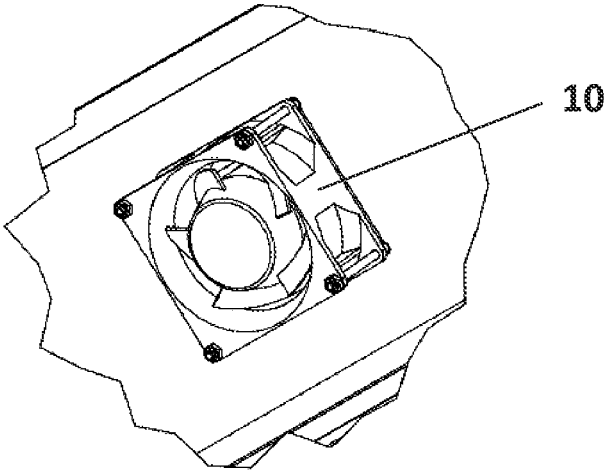

FIG. 8A: Details of the fan (10).

Figure 8B:
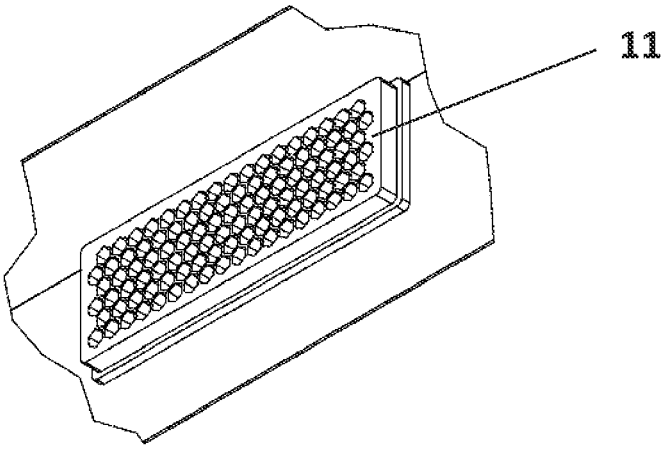

FIG. 8B: Details of the air filter (11).

DETAILED DESCRIPTION OF THE INVENTION

In one embodiment, the work surface is an aseptic interactive area for access to computational devices, for use in clean rooms.

In one embodiment, the work surface is intended for use in laboratory and hospital environments, with interactive zone for access to computational devices, which allows the digital record in work areas with chemical and/or biological agents, in a clean and hygienic manner.

In one embodiment, the work surface is comprised by a glass (1) on a plate of phenolic resins (3), and a set at the bottom comprised by a screen (7), film (2) and controller (6) suitably insulated in an enclosure (5).

In one embodiment, the work surface is characterised by said glass (1) with a maximum thickness of 12 mm, in particular a maximum thickness of 0 mm. One of the advantages thus provided is the improved detection when capacitive detection is used.

In one embodiment, the work surface is characterised by said glass (1) plus the phenolic resins plate or glass (3) with a minimum thickness of 8 mm and maximum of 30 mm. One of the advantages thus provided is more solid the construction of the work surface.

In one embodiment, the work surface is characterised by the isolation of a set of a screen (7), a film (2) and a controller (6) in an enclosure (5).

In one embodiment, the work surface is characterised by said enclosure (5), without sharp edges, in smooth material, airtight and that allows the output of cables, suitable for use in clean rooms and laboratories.

In one embodiment, the work surface is characterised by fixation to the connecting bars (4), without sharp edges, in smooth material and without perforations that are not required for assembly (not visible).

In one embodiment, the work surface is characterised in that it contains a support (8) for fixation to the screen (7) at a pre-defined distance from the glass (1).

In one embodiment, the or surface is characterised by a glass plate in replacement of the plate of phenolic resins (3) the total thickness of the set of two glasses may vary from 8 mm to 30 mm.

In one embodiment, the work surface is characterised in that said enclosure (5) with a built-in fan for active recirculation of the interior air promotes homogenisation/dissipation of the temperature inside the enclosure.

In one embodiment, the work surface is characterised in that said enclosure (5) with perforations, fan and filters interior air renewal provides active cooling. Air filtration at entrance/exit.

Immediately, on the embodiments of the invention that do not include a supplementary plate (3) under the top plate (1), the fixation of the enclosure (5), which contains the devices, is made to the top plate (1) or else to the structure of the equipment (9), for example, legs, frames, support frames, directly or via connections bars (4).

In certain embodiments, when the supplementary plate (3) is used, this is achieved by lamination in the complete area corresponding to the top plate (1) and by subsequent cropping in the area to receive the touch detection plate (2).

In one embodiment of the work surface, the supplementary plate (3) is placed in the area of the top plate (1) that is not covered by the touch detection plate (2).

In certain embodiments, when the supplementary plate (3) is used, this is made of ductile material that allows the fixation aided by hole and screw, for example with phenolic resin, medium density wood fibre board (MDF), high density wood fibre board madeira (HDF), polycarbonate, polyester or acrylic, or derivatives thereof, in particular clusters of polyester or acrylic with inert particles.

In one embodiment of the work surface, the supplementary plate (3) is placed in the area that corresponds to the top plate (1) and that comprises said touch detection plate (2) between the supplementary plate (3) and the top plate (1).

In the embodiments of the invention da that include two top plates (1A, 1B), the fixation of the enclosure (5), which contains the devices is made to the second top plate (1B) or is made to the structure of the equipment (for example, legs, frames, support frames), directly or via connection bars (4).

In embodiments, when two top plates (1A, 1B) are used with the touch detection plate (2) between one another, these are obtained by hot or cold rolling.

In certain embodiments, the enclosure (5) comprises a fan (10) for active heat dissipation, the fan being able to be associated to an opening in the enclosure (5) or placed in the interior of the enclosure without opening in the case of no opening, the heat dissipation is made through the outer surface of the enclosure (5).

Certain embodiments include a space between said touch detection plate (2) and said screen (7), so that the airflow caused by the fan (10) crosses this space.

In certain embodiments, the enclosure (5) comprises an air filter (11) associated to said fan, being the filter suitable to retain the agents present in said controlled laboratory environment, the fan (10) and the filter being placed in an opening of the enclosure (5).

In certain embodiments, said fan (10) is adapted for extracting air from inside the enclosure (5) to the outside of the enclosure (5).

Certain embodiments include entrance and/or exit doors placed in the enclosure (5), which are sealed or protected (for example, USB doors with IP65 protection and/or with lid).

Certain embodiments include appropriate elements for sealing the enclosure (5), such as O-rings or seals for example made of silicone either in its various openings (fan, entrance/exit doors), if any, or in the interface with the top plate (1).

In one embodiment, the degree of airtightness of the enclosure together with the plate to which the enclosure is coupled ensures a substantial sealing to the agents present in the controlled environment, for example according to the IP 54, IP55, IP64 or IP65 protection classes.

In one embodiment, the appropriate filter to retain the agents present in said controlled laboratory environment is a HEPA filter.

In explosive environments, all materials, seals and filters of said embodiments are adapted in such way as to prevent the risk of ignition and/or explosion.

The touch detection film is a particular case of a touch detection plate, and other similar technologies may be used, for example, magnetic.

In one embodiment of the work surface, a support structure (9) is coupled to the enclosure (5) that contains the touch detection plate (2) and the screen (7), in order to support their weight, being the top plate (1), possibly with the supplementary plate (3) or with the second top plate (1B) as the case may be and if used, placed on top of the set.

In one embodiment of the work surface, the enclosure (5), which contains the touch detection plate (2) and the screen (7), is coupled under the top plate (1), or if used it is coupled under the supplementary plate (3), or if used it is coupled under the second plate (1B), being then the set placed on top of the supporting structure (9).

The embodiments described can be combined. The following dependent claims define preferred embodiments of the present invention.

The invention claimed is:

1. A work surface for controlled laboratory environment characterized in that it comprises:

a. a top plate (1) comprising glass or other rigid material that is transparent, non-porous, and chemically resistant;

b. a touch detection plate, in particular multi-touch (2), disposed under the top plate (1);

c. a supplementary plate (3) comprising glass, resin or other material that is rigid, non-porous, and chemically resistant said supplementary plate (3) disposed under, and serving as support for, said top plate (1);

d. a screen (7), placed under the touch detection plate (2);

e. an enclosure (5) substantially sealed to the supplementary plate, said enclosure containing therein the touch detection plate (2) and the screen (7);

f. a supporting structure (4, 8) of the work surface supporting the enclosure (5) and disposed between the enclosure (5) and the supplementary plate (3), wherein the supplementary plate (3) is configured to receive the touch detection plate (2), and said supplementary plate (3) is placed in the area under the top plate (1) not covered by the touch detection plate (2).

2. The work surface for controlled laboratory environment according to claim 1, wherein the enclosure (5) comprises a fan (10) for active recirculation of air from inside the enclosure which promotes dissipation of heat.

3. The work surface for controlled laboratory environment according to claim 2, wherein the enclosure (5) comprises an air filter (11) associated to said fan, the fan (10) and the filter being placed in an opening of said enclosure (5).

4. The work surface for controlled laboratory environment according to claim 3, wherein the top plate (1) is glass or polycarbonate, in particular laminated glass, chemically enriched glass for greater resistance, or tempered glass.

5. The work surface for controlled laboratory environment according to claim 3, wherein said fan (10) is placed in an opening of the enclosure (5) and is adapted for extracting air from inside the enclosure (5) to the outside of the enclosure (5) through the opening of said enclosure (5).

6. The work surface for controlled laboratory environment according to claim 3, wherein the supplementary plate (3) is made of glass, resin, phenolic resin, medium density wood fiber board (MDF), high density wood fiber board (HDF), polycarbonate, polyester or acrylic, or derivatives thereof, in particular clusters of polyester or acrylic with inert particles.

7. The work surface for controlled laboratory environment according to claim 2, wherein the supplementary plate (3) is made of glass, resin, phenolic resin, medium density wood fiber board (MDF), high density wood fiber board (HDF), polycarbonate, polyester or acrylic, or derivatives thereof, in particular clusters of polyester or acrylic with inert particles.

8. The work surface for controlled laboratory environment according to claim 2 that comprises a space between said touch detection plate (2) and said screen (7), so that the airflow caused by said fan (10) crosses this space.

9. The work surface for controlled laboratory environment according to claim 8, wherein the enclosure (5) comprises an air filter (11) associated to said fan, the fan (10) and the filter being placed in an opening of said enclosure (5).

10. The work surface for controlled laboratory environment according to claim 8, wherein said fan (10) is placed in an opening of the enclosure (5) and is adapted for extracting air from inside the enclosure (5) to the outside of the enclosure (5) through the opening of said enclosure (5).

11. The work surface for controlled laboratory environment according to claim 8, wherein the supplementary plate (3) is made of glass, resin, phenolic resin, medium density wood fiber board (MDF), high density wood fiber board (HDF), polycarbonate, polyester or acrylic, or derivatives thereof, in particular clusters of polyester or acrylic with inert particles.

12. The work surface for controlled laboratory environment according to claim 2, wherein said fan (10) is placed in an opening of the enclosure (5) and is adapted for extracting air from inside the enclosure (5) to the outside of the enclosure (5) through the opening of said enclosure (5).

13. The work surface for controlled laboratory environment according to claim 12, wherein the top plate (1) is glass or polycarbonate, in particular laminated glass, chemically enriched glass for greater resistance, or tempered glass.

14. The work surface for controlled laboratory environment according to claim 12, wherein the supplementary plate (3) is made of glass, resin, phenolic resin, medium density wood fiber board (MDF), high density wood fiber board (HDF), polycarbonate, polyester or acrylic, or derivatives thereof, in particular clusters of polyester or acrylic with inert particles.

15. The work surface for controlled laboratory environment according to claim 1, wherein the supplementary plate (3) is made of glass, resin, phenolic resin, medium density wood fiber board (MDF), high density wood fiber (HDF), polycarbonate, polyester or acrylic, or derivatives thereof, in particular clusters of polyester or acrylic with inert particles.

16. The work surface for controlled laboratory environment according to claim 1, wherein a top plate (1) covers the entire top of the work surface, so that there are no cracks or roughness on its top.

17. The work surface for controlled laboratory environment according to claim 1, wherein the top plate (1) has a thickness of 12 mm, in particular up to 8 mm.

18. The work surface for controlled laboratory environment according to claim 1, wherein the top plate (1) and the supplementary plate (3) have a joint thickness of 8 to 30 mm.

19. The work surface for controlled laboratory environment according to claim 1, wherein the thickness of the top plate (1) and the supplementary plate (3), as well as a sensibility of the touch detection plate (2) are such that they detect touches of fingers wearing gloves.

20. The work surface for controlled laboratory environment according to claim 1 that comprises material substantially smooth, without sharp edges, without visible holes and without unfilled holes.

* * * * *